US010294090B2

(12) United States Patent
Clüsserath

(10) Patent No.: US 10,294,090 B2
(45) Date of Patent: May 21, 2019

(54) METHOD AND FILLING SYSTEM FOR FILLING CONTAINERS

(71) Applicant: KHS GmbH, Bad Kreuznach (DE)

(72) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 286 days.

(21) Appl. No.: 14/915,435

(22) PCT Filed: Aug. 1, 2014

(86) PCT No.: PCT/EP2014/066579
§ 371 (c)(1),
(2) Date: Feb. 29, 2016

(87) PCT Pub. No.: WO2015/028249
PCT Pub. Date: Mar. 5, 2015

(65) Prior Publication Data

US 2016/0214845 A1 Jul. 28, 2016

(30) Foreign Application Priority Data

Aug. 30, 2013 (DE) ..... 10 2013 109 430

(51) Int. Cl.
*B67C 3/10* (2006.01)
*B67C 3/26* (2006.01)

(52) U.S. Cl.
CPC ..... *B67C 3/10* (2013.01); *B67C 3/262* (2013.01); *B67C 3/2628* (2013.01)

(58) Field of Classification Search
CPC ..... B67C 3/10; B67C 3/262; B67C 3/2628; B67C 3/00
USPC ..... 141/57, 5
See application file for complete search history.

(56) References Cited

U.S. PATENT DOCUMENTS 5,634,500 A * 6/1997 Clusserath ..... B67C 3/10 141/44
6,189,578 B1 * 2/2001 Clusserath ..... B67C 3/10 141/293
6,470,922 B2 * 10/2002 Sindermann ..... B67C 3/10 141/37
6,474,368 B2 * 11/2002 Clusserath ..... B67C 3/12 141/129
7,469,726 B2 * 12/2008 Clusserath ..... B67C 3/04 141/57
7,721,773 B2 * 5/2010 Stadlmayr ..... A23L 2/54 141/302
2002/0014276 A1 * 2/2002 Clusserath ..... B67C 3/065 141/40

FOREIGN PATENT DOCUMENTS

DE 38 25 093 1/1990
DE 42 25 476 2/1994
(Continued)

*Primary Examiner* — Jason K Niesz
*Assistant Examiner* — James R Hakomaki
(74) *Attorney, Agent, or Firm* — Occhiuti & Rohlicek LLP

(57) ABSTRACT

A pressure filling method for pressure filling a container that has been sealed against a filling element includes connecting a container's interior to a vacuum, evacuating its contents, and flushing it with gas, at least some of which has been recovered during container processing and that has already been used during container processing.

20 Claims, 6 Drawing Sheets

(56) References Cited

FOREIGN PATENT DOCUMENTS

| | | | | |
|---|---|---|---|---|
| DE | 19606465 C1 * | 10/1997 | ..... | B67C 3/16 |
| DE | 199 39 521 | 9/2000 | | |
| DE | 100 08 426 | 8/2001 | | |
| EP | 0 554 690 | 8/1993 | | |
| EP | 1 270 499 | 1/2003 | | |
| JP | 2005 313928 | 11/2005 | | |
| WO | WO2014/154332 | 10/2014 | | |
| WO | WO2015/004001 | 1/2015 | | |

* cited by examiner

METHOD AND FILLING SYSTEM FOR FILLING CONTAINERS

RELATED APPLICATIONS

This is the national stage, under 35 USC 371, of PCT application PCT/EP2014/066579, filed on Aug. 1, 2014, which claims the benefit of the Aug. 30, 2013 priority date of German application DE 10 2013 109 430.9, the contents of which are herein incorporated by reference.

FIELD OF INVENTION

The invention relates to filling containers, and in particular, to pressure filling.

BACKGROUND

In the course of pressure filling a container, it is often useful to flush the container with an inert gas. This drives out any ambient air, which contains oxygen that may impair product quality over time.

A disadvantage of having to flush containers is that one must supply an inert gas, such as CO2. The cost of this flushing gas is not insignificant.

SUMMARY

An object of the invention is to reduce the consumption of inert gas during filling without impairing quality.

In one aspect, the invention features a method that includes introducing flushing gas into an evacuated container that is connected to a vacuum source, to a source of underpressure, or to a vacuum channel of a filling system. This flushing gas is introduced with no overpressure, or with essentially no overpressure, or only very little or negligible overpressure, or at most with only a modicum of overpressure. Examples of suitable absolute pressures are 1.0 bar, 1.05, and 1.1 bar. The container's interior is at an underpressure. Examples of suitable underpressures are underpressures between 50 mbar and 200 mbar, and underpressures of about 100 mbar. This procedure of flushing into the vacuum alone saves considerable amounts of flushing gas.

Another aspect of the invention includes recovering flushing gas from a pressure-relief channel that receives gas from containers during a pressure-relieving phase that occurs near the end of a filling procedure when the pressure inside a container's interior is relieved to near ambient pressure. This brings the inert gas or CO2 gas used as flushing gas to atmospheric or ambient pressure. By suitable means, for example by a choke in the connection line of the pressure-relief channel to the free atmosphere of the surrounding area, the pressure inside the pressure-relief channel can also be set to a value slightly above atmospheric pressure, for example to a pressure of 1.05 bar to 1.3 bar.

In one aspect, the invention features a method for pressure filling containers with liquid filling content. Such a method includes sealing a container against a filling element of a filling system, evacuating its interior by connecting it to a vacuum, and flushing its interior with gas, at least some of which has already been used during container processing, filling the container's interior with gas under pressure, relieving pressure in the container's interior, and during either or both evacuation and flushing, subjecting the container's interior to an internal pressure that is within a range of approximately 50 mbar and approximately 200 mbar.

Some practices include recovering at least some of the inert gas from a pressure-relief channel that has been used to collect used inert gas. Alternative practices are those in which flushing includes introducing into the container's interior at a pressure of between 1.0 bar and 1.1 bar.

Yet other practices include those in which flushing includes recovering gas that has already been used for container processing, with the recovered gas being at a pressure that is at or slightly above ambient pressure.

Also among the practices of the invention are those in which flushing includes subjecting the interior to a pressure of 100 mbar.

In other practices, flushing includes introducing the gas into the interior along a path that is centered in the container.

Yet other practices include those in which flushing includes flushing with a mixture of fresh inert gas that has not yet been used in container processing and recovered inert gas, as well as those in which flushing includes flushing only with recovered inert gas that has already been used in container processing.

In other practices, pressure filling further includes connecting the container's interior to both a flushing channel that is connected to a source of the gas and to a return-gas channel that is connected to a vacuum. In such practices, flushing includes introducing the gas through the flushing channel while the return-gas channel is connected to the vacuum.

Yet other practices are those in which pressure filling includes using a single-chamber filling system including a filling element that includes a return gas tube that is configured to extend into the container during container processing. In these practices, flushing includes introducing the gas via a return gas channel formed in the return gas tube, and connecting the container's interior via at least one controlled gas path to a vacuum channel of the single-chamber filling system, wherein the controlled gas path opens at a filling content output opening of the filling element. Among these practices are those that also include controlling a return gas valve formed in the filling element to control a connection between the return gas tube and a gas chamber of a reservoir of liquid filling-content, the return gas valve having a valve body, wherein flushing includes causing gas to pass through the valve body.

The method as described herein reduces consumption of flushing gas by some 70% over conventional methods. This reduction in the flushing gas quantity also reduces suction volume and therefore the required capacity of the vacuum pump connected to the vacuum channel. This, in turn, reduces operating costs for electricity and cooling, as well as investment costs.

In another aspect, the invention includes a filling system having a pressure-relief channel, a vacuum channel, and a filling-content reservoir, all of which are connected to a plurality of filling elements. Each of these filling elements has a liquid channel formed in a housing thereof. The liquid channel ends in an annular discharge opening on the filling element's underside. During operation, this opening discharges liquid filling-content from the filling-content reservoir into a container sealed against the filling element. The filling element has a flushing tube having a flushing channel extending through it. This flushing tube and a return gas tube extend downward through the opening during filling of a container. The housing also has, formed therein, first and second gas chambers. An end of the return gas channel opens into the first gas chamber. The flushing channel opens into the second gas chamber. Three control valves cooperate to orchestrate the formation and reformation of controlled paths within the housing during the course of the container processing. A first control valve selectively connects and disconnects the pressure relief channel and the second gas chamber. A second control valve selectively connects and disconnects the vacuum channel, the flushing channel of the flushing tube, and the first gas chamber during evacuation and flushing of the container. A third control valve selectively connects and disconnects the vacuum channel, the return gas channel, and the pressure relief channel during the residual pressure relief phase.

Some embodiments have an additional control valve to selectively connect and disconnect the first gas chamber and the return gas channel from a gas chamber in the filling-content reservoir.

Other embodiments have an additional control valve that selectively connects and disconnects a choked connection between a gas chamber in the filling-content reservoir, the first gas chamber, and the return gas channel.

Yet other embodiments include an additional control valve that selectively connects and disconnects the second gas chamber and the flushing channel with a gas chamber in the filling-content reservoir.

In another aspect, the invention features a single-chamber filling system having a reservoir, a pressure-relief channel, and a vacuum channel. During filling, the reservoir is partially filled with liquid filling-content such that the liquid filling-content defines a lower liquid chamber and an upper gas chamber. The filling system also has a plurality of filling elements, each of which is arranged to be partially within the reservoir. All of these filling elements connect to both the pressure-relief channel and the vacuum channel. Each filling element has an outlet that discharges liquid filling-content into a container sealed against the filling element, and a liquid valve having a valve body formed on a valve tappet through which a return-gas tube defining a return-gas channel is also formed. Each filling element also has a return-gas valve that controls a connection between the gas channel and the upper gas chamber. There are two control valves that form and reform paths during operation. One control valve selectively connects the return-gas channel to the pressure relief channel; the other control valve selectively connects the vacuum channel to a gas path that opens at the outlet.

Some embodiments also include a gas path that connects the gas channel through the return gas tube to the first control valve. This the gas path leads through the valve body of the return gas valve.

Yet other embodiments have an additional control valve, Suring residual pressure relief of the container, the additional control valve connects a head space of the container to the pressure relief channel.

Still other embodiments include an inert gas source that is connected to the plurality of filling elements for providing fresh inert gas to all of the filling elements. In these embodiments, the filling element has an additional control valve that connects the gas channel through the return gas tube connects to the inert gas source.

As used herein, "pressure filling" means a filling method with which the container that is to be filled is sealed against the filling element and, as a rule, before the actual filling phase, i.e. before the opening of the liquid valve, is subjected to preliminary pressure via at least one controlled gas path, formed in the filling element by a span gas (inert gas or CO2 gas) that is under pressure, which, during the filling, is then increasingly forced out of the container interior by the filling product flowing into the container, as return gas, and specifically likewise via at least one controlled gas path formed in the filling element. This preliminary pressure phase precedes further treatment phases, namely the evacuation and flushing of the respective container interior with the inert gas, e.g. CO2 gas.

As used herein, the term "containers in the sealing position, with the treatment head or filling element" means that the container is pressed in contact with its container mouth tight against the treatment head or filling element, or against a sealing element located there.

As used herein, a "containers" refers to cans or bottles, whether made of metal, glass, and/or plastic.

As used herein, a "rotating filling machine" is a filling machine with a rotating transport element, such as a rotor, and with filling positions formed at the transport element for the filling of the containers.

As used herein, terms such as "essentially" or "some" or "approximately" are used to describe deviations from an exact value by ±10%, preferably by ±5%, and/or deviations that are insignificant to function.

BRIEF DESCRIPTION OF THE DRAWINGS

These and other features and advantages of the invention will be apparent from the following detailed description and the accompanying drawings in which.

DETAILED DESCRIPTION

Figure 1:
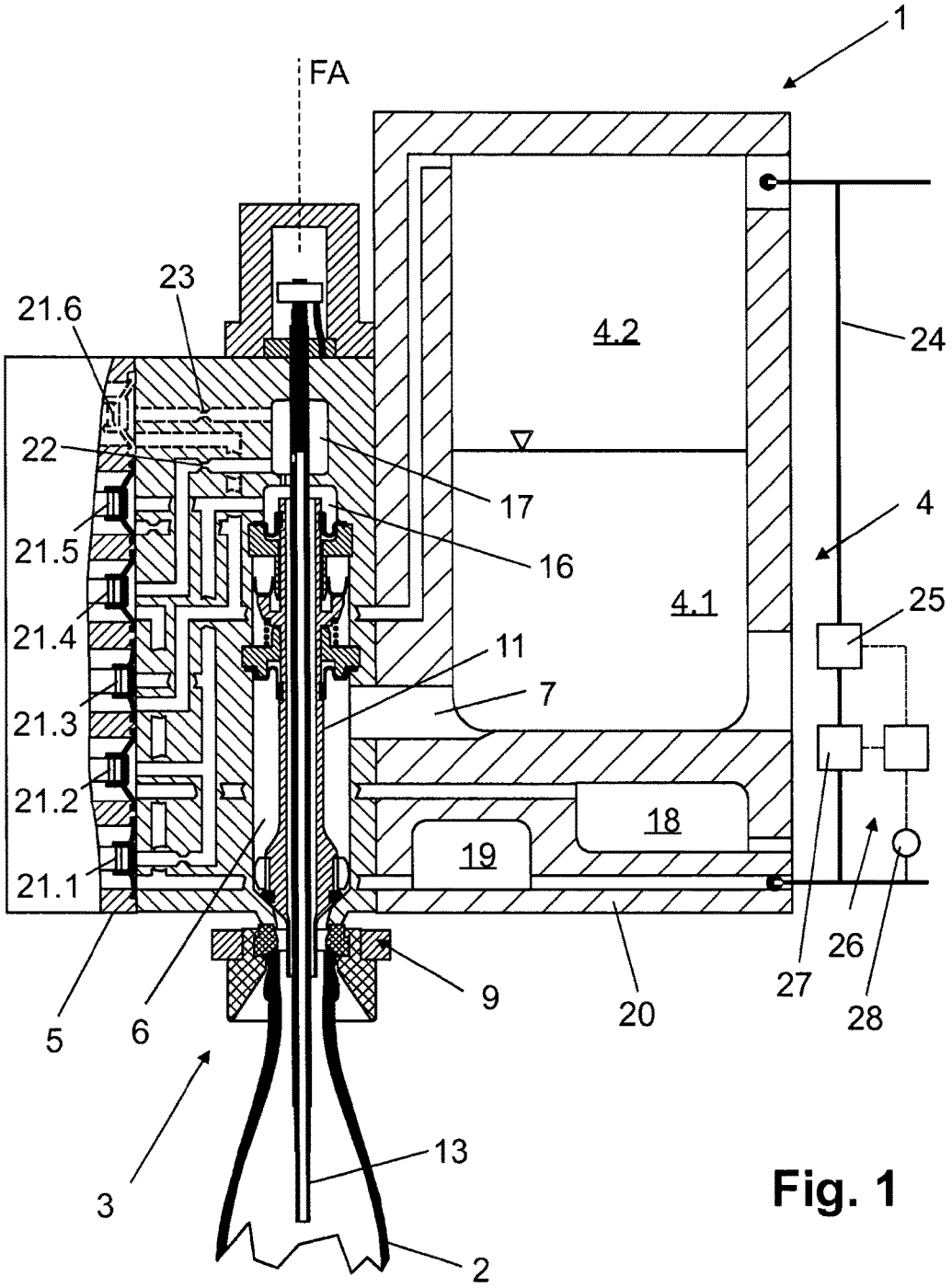
FIG. 1 is a sectional view of a filling element for pressure filling containers with liquid content.

FIG. 1 shows a portion of a filling machine 1 for pressure-filling containers 2, such as bottles, with liquid filling-content. The filling machine 1 includes a plurality of filling elements 3, one of which can be seen in FIG. 1. It also includes a filling-product reservoir 4 that is common to all the filling elements. In the case of a rotating filling machine 1, the filling-product reservoir 4 is an annular tank surrounding a vertical machine axis.

During filling, liquid filling-content that partially fills the filling-product reservoir 4 forms a reservoir liquid-chamber 4.1 within the reservoir 4. An inert gas maintained at a filling pressure defines a reservoir gas-chamber 4.2 above the reservoir liquid-chamber 4.1. A suitable inert gas for filling the reservoir gas-chamber 4.2 is carbon dioxide gas.

Figure 3:
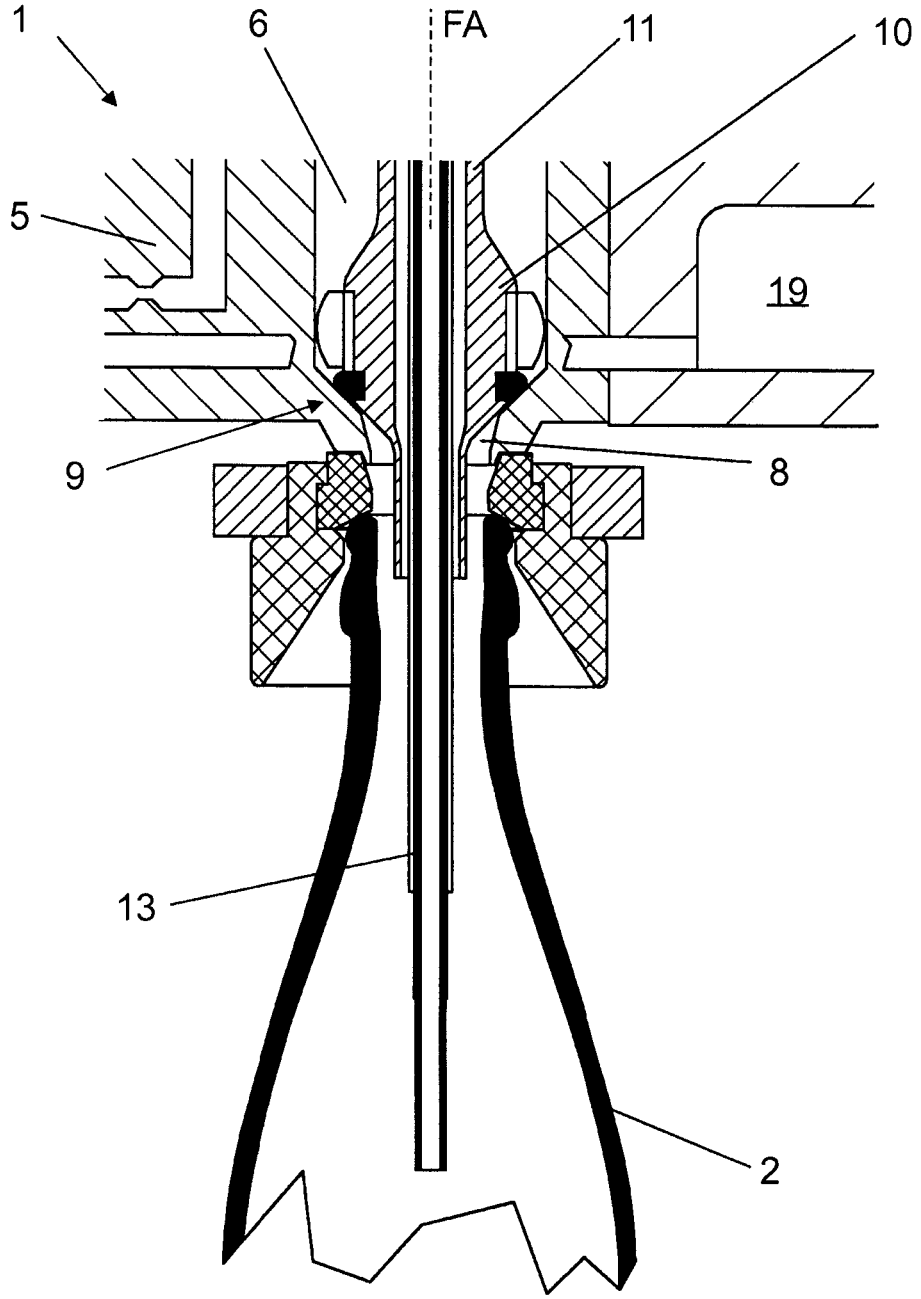

Each filling element 3 comprises a filling element housing 5 with a liquid channel 6 that connects to the reservoir liquid-chamber 4.1 via a connection 7. As shown in FIG. 3, the liquid channel 6 forms an annular opening 8 on an underside of the filling element housing 5. During filling, liquid filling-content flows through the annular opening 8 and into a container 2 that is sealed against the filling element 3.

A liquid valve 9 controls flow of liquid into the container. The liquid valve 9 includes a liquid-valve body 10 that is formed on a distal end of a return-gas tube 11 coaxial with the filling-element axis. The return-gas tube 11 thus functions as a valve tappet. To open and close the liquid valve 9, one raises and lowers the liquid-valve body 10 in a controlled manner along a vertical filling-element axis FA. When the liquid valve 9 closes, the liquid-valve body 10 interacts with a valve seat in the liquid channel 6.

During the filling phase, a lower portion of the return-gas tube 11 extends into a headspace of a container 2, as shown in FIG. 3. An upper portion of the return-gas tube 11 interacts with an actuation device 12 for the opening and closing of the liquid valve 9, as shown in FIG. 2.

Figure 4:
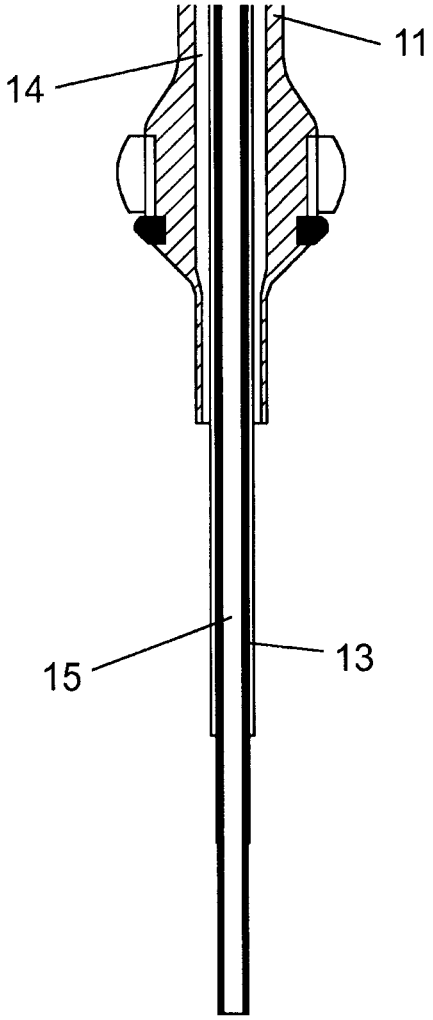
FIG. 4 shows a flushing tube surrounded by a ring-shaped return gas channel of the filling element from FIG. 1.

Referring to FIG. 4, a flushing tube 13 defines a flushing channel 15 that extends through the return-gas tube 11. The flushing tube 13 is coaxial with the filling-element axis FA. Like the return-gas tube 11, the flushing tube 13 has open upper and lower ends. An annular gap between the return gas tube 11 and the flushing tube 13 defines an annular return-gas channel 14. The flushing tube's open lower end projects into the container 2 beyond the lower open end of the return gas tube 11.

At its upper end, the return-gas channel 14 opens into a first gas-chamber 16 formed in the filling element housing 5. Similarly, the upper end of the flushing channel 15 opens into a second gas-chamber 17 that is also formed in the filling element housing 5.

Figure 2:
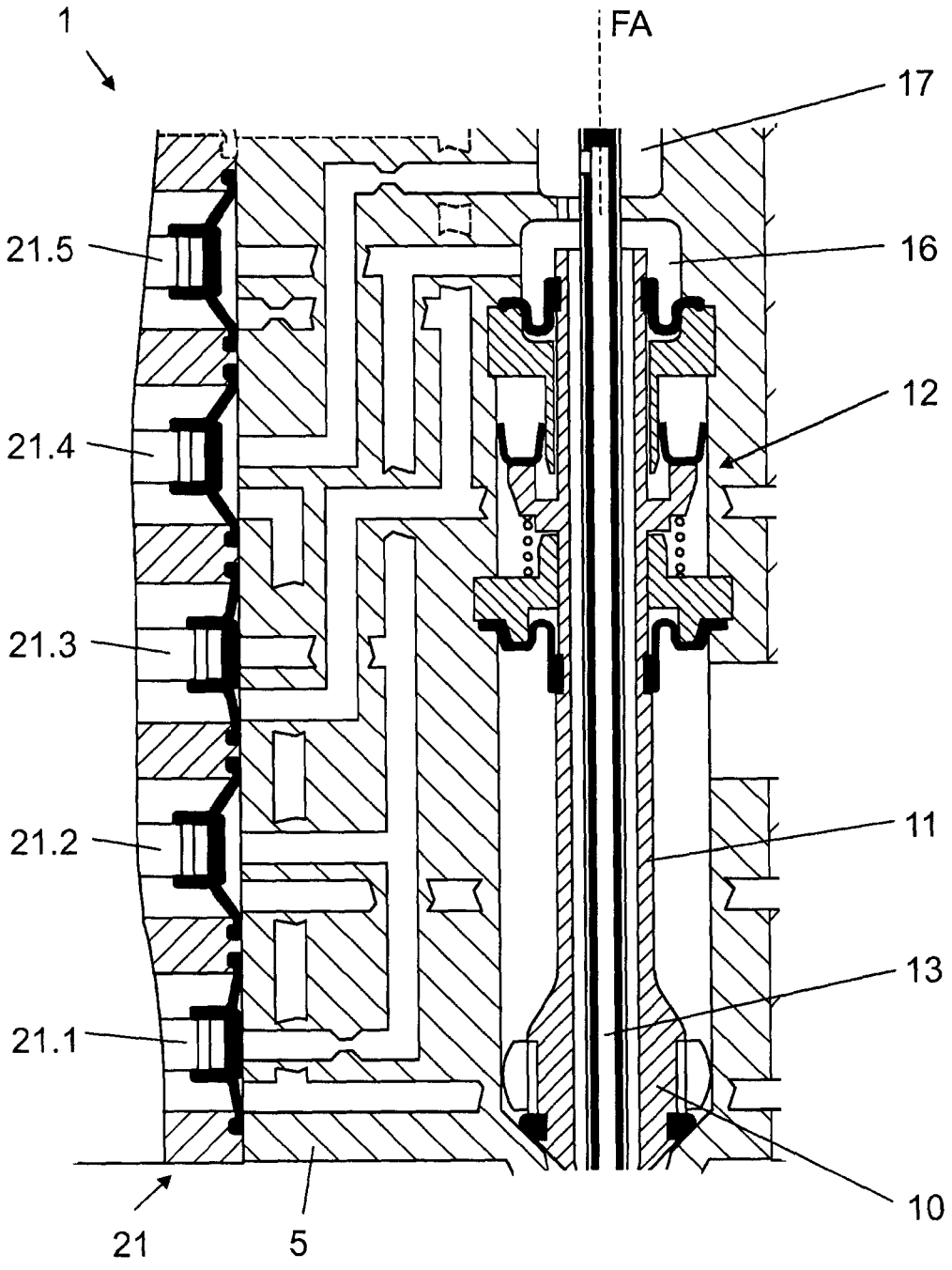
FIGS. 2 and 3 are enlarged views showing details of the filling element from FIG. 1.

Referring to FIG. 2, the first and second gas-chambers 16, 17 are constituent parts of controlled gas channels 21 formed in the filling element housing 5. These controlled gas channels 21 carry out various preliminary procedures that precede the actual filling phase of a container 2 sealed against the filling element 3.

The filling system 1 further includes a vacuum channel 18 and a pressure-relief channel 19 that are common to all the filling elements 3 of the filling system 1. The vacuum channel 18 and the pressure-relief channel 19 connect to the controlled gas-paths 21 of each filling element 3. A rotor 20 configured to rotate about the vertical machine axis supports the filling-product reservoir 4, the vacuum channel 18, the pressure-relief channel 19, and the filling elements 3.

First through sixth control valves 21.1-21.6 cooperate to open and close selected ones of the controlled gas-paths 21. The first through sixth control valves 21.1-21.6 are preferably pneumatically-actuatable valves that are arranged in the controlled gas-paths 21 and that allow controlled connection of the first and second gas-chambers 16, 17 with the reservoir gas-chamber 4.2, with the vacuum channel 18, and with the pressure-relief channel 19, as described below.

The input sides of the first and fourth control valves 21.1, 21.4 connect to the pressure-relief channel 19. The input sides of the third, fifth, and sixth control valves 21.3, 21.5, 21.6 connect to the reservoir gas-chamber 4.2. The output sides of the first, second, third, and fifth control valves 21.1, 21.2, 21.3 connect to the first gas-chamber 16. The output sides of the fourth and sixth control valves 21.4 21.6 connect to the second gas-chamber 17. The input side of the second control valve 21.2 connects to the vacuum channel 18.

The vacuum channel 18 connects to a vacuum source or vacuum pump that creates an underpressure in the vacuum channel 18. In typical embodiments, the underpressure is between 90 mbar and 110 mbar, for example, around 100 mbar. The pressure-relief channel 19 brings inert gas, e.g. the CO2 gas, at the residual pressure relief of the respective container 2 at the end of the filling phase up to ambient pressure.

In detail, the filling system 1 fills containers 2 in a multi-stage filling process with the following process steps. In the following description, the liquid valve 9 and the first through sixth control valves 21.1-21.6 are closed unless otherwise stated. The container 2 is sealed against the filling element 3 during all of the following steps.

The first step is to evacuate the container 2. This proceeds by opening the second control valve 21.2 to connect the first gas-chamber 16 to the vacuum channel 18, thus evacuating the container's interior via the return-gas channel 14.

The next step is to flush the container 2 with inert gas. This proceeds by opening the fourth control valve 21.4 and the second control valve 21.2. Opening the fourth control valve 21.4 connects the second gas-chamber 17 to the pressure-relief channel 19 via the flushing channel 15. Opening the second control valve 21.2 connects the first gas-chamber 16 and the return-gas channel 14 to the vacuum channel 18. This causes carbon-dioxide gas to flow out of the pressure-relief channel 19, via the flushing channel 15 into the container's evacuated interior. This incoming gas forces gas out of the container's interior. The gas leaves the container via the return-gas channel 14 and proceeds into the vacuum channel 18.

A pressure level corresponding or essentially corresponding to the ambient pressure in the pressure-relief channel 19 at the underpressure that is formed by the connection of the container's interior to the vacuum channel 18 is sufficient for flushing the container's interior to the extent required.

For the final evacuation of the container 2, the second control valve 21.2 remains open and the fourth control valve 21.4 closes. This configuration connects the container's interior to the vacuum channel 18 via the return-gas channel 14 and the first gas-chamber 16.

The next step is to pressurize the container by opening the third control valve 21.3 to connect the first gas-chamber 16, and therefore the return-gas channel 14, to the reservoir gas-chamber 4.2. With the container still sealed against the filling element 3, this pressurizes the container's interior. As a result, inert gas can flow out of the reservoir gas-chamber 4.2 under filling pressure and into the container's evacuated interior.

Opening the liquid valve 9, the third control valve 21.3, and the fifth control valve 21.5 carries out the next step, which is to rapidly fill the container 2. Opening the liquid valve 9 permits filling-content to enter the container 2, while opening the third and fifth control valves 21.3, 21.5 permits this incoming liquid filling content to force inert gas out of the container 2 through the return-gas channel 14 and into the first gas-chamber 16, as well as parallel to this into the reservoir gas-chamber 4.2 via a choked gas path comprising the fifth control valve 21.5.

The next step is to slow down the filling rate. This proceeds by closing all but the fifth control valve 21.5 and the liquid valve 9. As a result, inert gas that is forced by the inflowing filling content out of the container interior can only flow back in a choked manner via the return-gas channel 14, the first gas-chamber 16, and a first choke 22, into the reservoir gas-chamber 4.2.

The next step is to close all of the control valves 21.1-21.6 and the liquid valve 9. This calms the liquid filling content.

The last step is to relieve residual pressure in the head space, in the return-gas channel 14, the flushing channel 15, and the controlled gas-paths 21. To carry out this pressure relief, one opens the first control-valve 21.1 and the fourth control-valve 21.4. This connects the first and second gas-chambers 16, 17 to the pressure-relief channel 19.

Some practices of the filling procedure also include flushing the container's interior with inert gas from the reservoir gas-chamber 4.2. This is carried out by opening the sixth control-valve 21.6 to form a path between the second gas-chamber 17 and the reservoir gas-chamber 4.2. A second choke 23, which lies in the path between the second gas-chamber 17 and the reservoir gas-chamber 4.2, limits flow of inert gas into the container's interior as it travels from the reservoir gas-chamber 4.2, via the second gas-chamber 17 through the flushing channel 15. This flow-limiting occurs while the second control-valve 21.2 connects the container's interior to the vacuum channel 18 via the first gas-chamber 16 and the return gas-channel 14. This optional or additional flushing with inert gas from the reservoir gas-chamber 4.2 takes place, for example, with shortened flushing duration after a container has been flushed with the inert gas from the pressure-relief channel 19.

In a filling element 3 that does not flush the container's interior from the reservoir gas-chamber 4.2, no sixth control-valve 21.6 is needed. Such a filling element 3 thus requires only the first through fifth control valves 21.1-21.5.

Among the advantages of the foregoing filling method is that the evacuated container's interior remains connected to the vacuum channel 18 as inert gas from the pressure-relief channel 19 enters. This substantially reduces inert gas consumption during flushing. In some cases, the reduction is by as much as 70%.

The optional flushing from the reservoir gas-chamber 4.2 via the opened control-valve 21.6 and the gas path comprising the first choke 22 also takes place preferably if the quantity of gas from the pressure-relief channel 19 is insufficient. There is also the possibility, in the event of a deficit of gas in the pressure-relief channel 19, of feeding inert gas into it in a regulated manner from the reservoir gas-chamber 4.2, and specifically via a connection 24 with a flowmeter 25 and a pressure regulating circuit 26 with control valve 27, which is controlled as a function of the flowmeter 25 and of a pressure sensor 28, the latter element monitoring the gas pressure in the pressure-relief channel 19.

Figure 5:
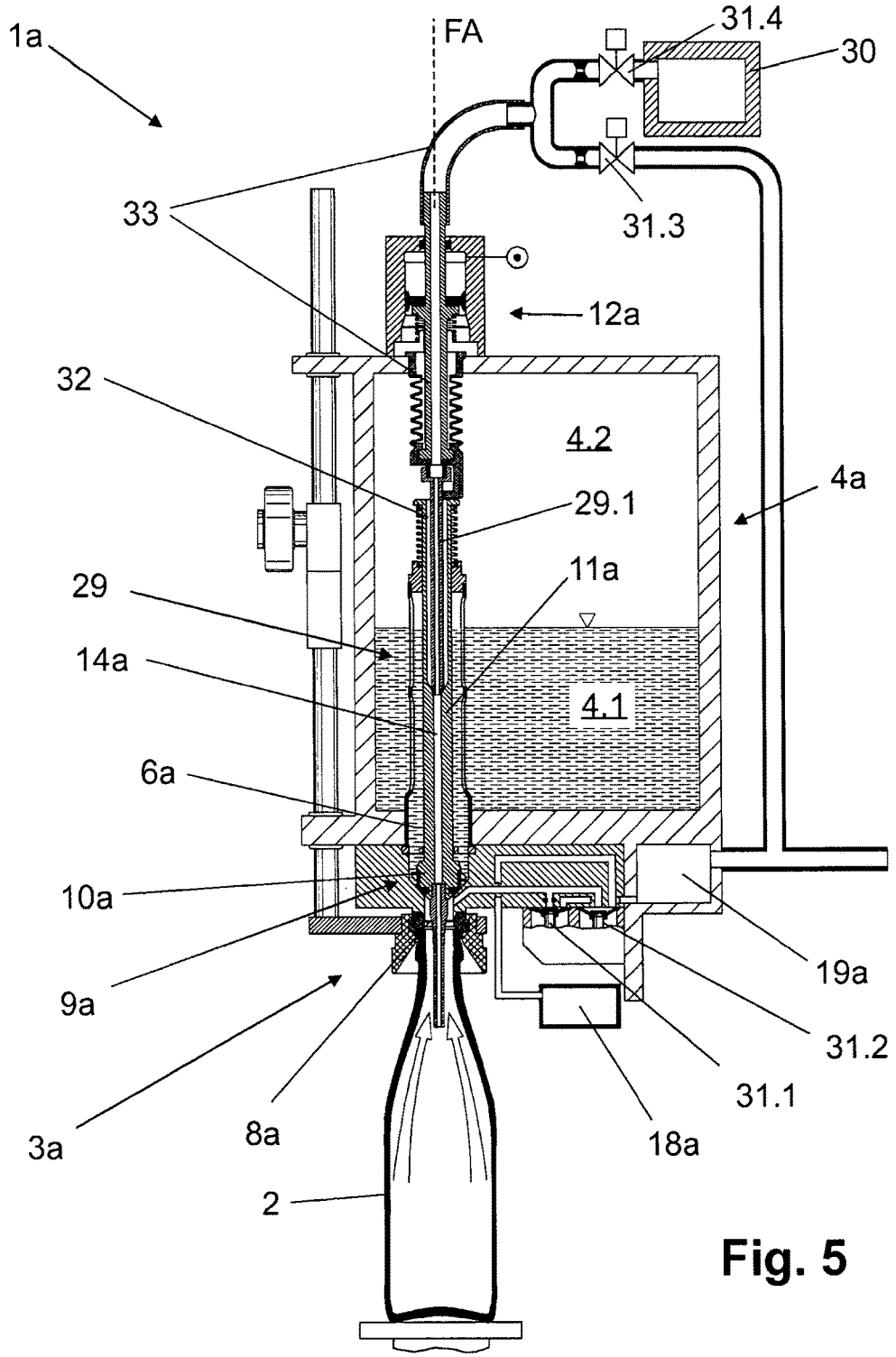
FIG. 5 shows an alternative embodiment of the filling system according to the invention.
Figure 6:
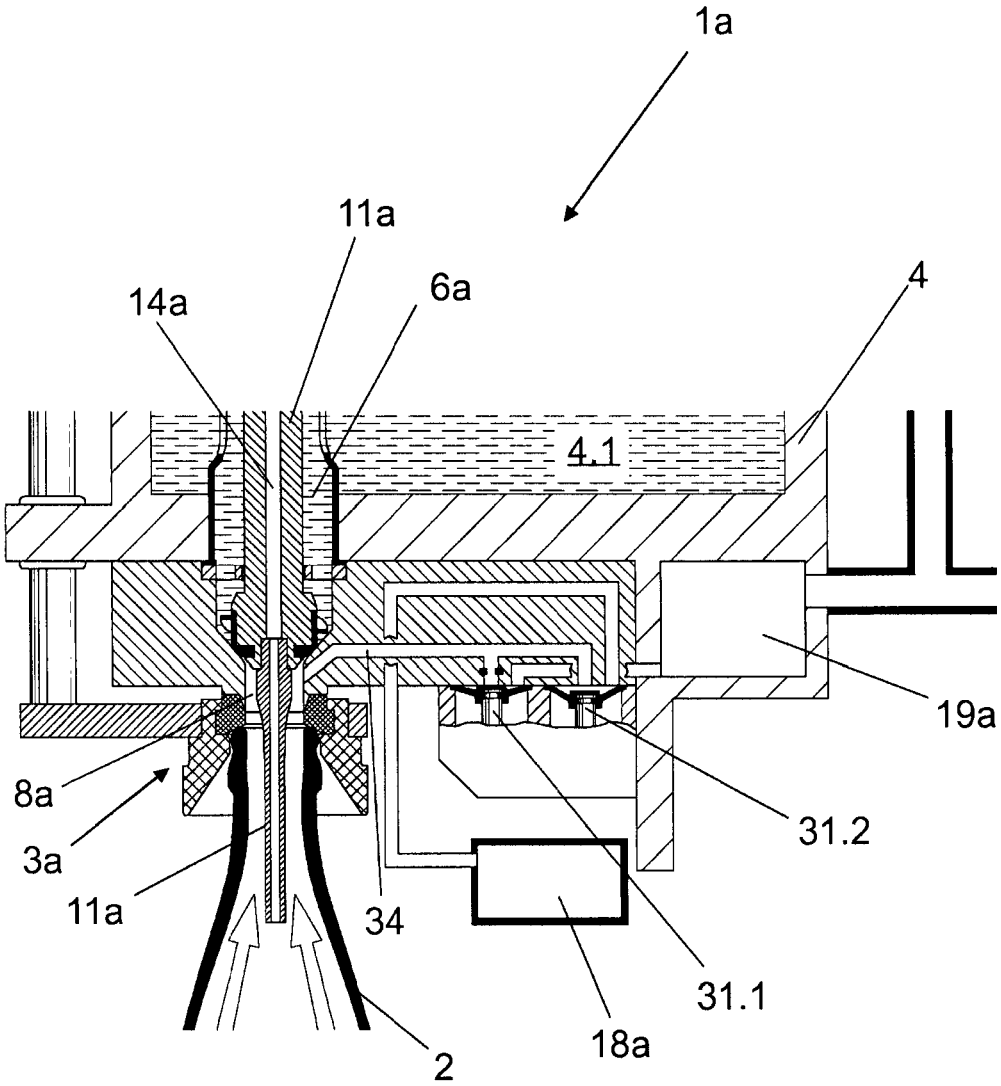
FIG. 6 shows details of the filling element from FIG. 5.

In an alternative embodiment, shown in FIGS. 5 and 6, a single-chamber filling system 1*a* has a filling element 3*a* that is at least partially in the filling content reservoir 4*a*. In this embodiment, the annular outlet 8*a* for discharging filling content is directly beneath the filling content reservoir 4*a*. The filling system 1*a* pressure fills bottles that have been sealed against the filling elements 3*a*. During the filling process, liquid filling-content partially fills the filling content-reservoir 4*a* to form a reservoir liquid-chamber 4.1 and a reservoir gas-chamber 4.2 below the reservoir liquid-chamber 4.1. An inert gas under filling pressure, such as carbon dioxide gas, fills the reservoir gas-chamber 4.2.

Each filling element 3*a* has a liquid channel 6*a* that connects to the reservoir liquid-chamber 4.1. On the underside of the filling element and beneath the filling content 4*a*, the liquid channel 6*a* forms an annular outlet 8*a* through which the filling content flows into the container's interior when the liquid valve 9*a* opens.

The liquid valve 9*a* has a liquid-valve body 10*a* on a return-gas tube 11*a* coaxial with a filling element axis FA. Raising and lowering the liquid-valve body 10*a* opens and closes the liquid valve 9*a*.

This return-gas tube 11*a* defines a return-gas channel 14*a*. A return-gas valve 29 selectively connects the return-gas channel 14*a* to the reservoir gas-chamber 4.2. In some embodiments, the return-gas valve 29 is a needle valve having a needle-shaped valve body 29.1 that can be opened and closed in a controlled manner.

An actuator 12*a* raises and lowers the needle-shaped valve body 29.1 relative to the return gas-tube 11*a* to open and close the return-gas valve 29. In some embodiments, the actuator 12*a* is a lifting device. In these embodiments, the actuator 12*a* executes a first opening lift that raises only the valve body 29.1, thus opening the return gas valve 29. Then, thin a second opening lift, the actuator 12*a* raises the liquid-valve body 10*a*, thus opening the liquid valve 9*a*

The filling system 1*a* also has a vacuum channel 18*a* and a pressure-relief channel 19*a*, both of which are common for all the filling elements 3*a* of the filling system 1*a*. In those cases where the filling system 1*a* is a rotating filling-machine and the filling-content reservoir 4*a* is a ring container, the vacuum channel 18*a* and the pressure-relief channel 19*a* are either on the underside of the reservoir 4*a* or at a rotor that is driven to rotate about a vertical machine axis.

Each filling element 3*a*, or in some cases each pair of filling elements 3*a*, couples to controlled gas paths that are controlled by first through fourth control valves 31.1-31.4. The first through fourth control valves 31.1-31.4 control evacuation and flushing of a container 2 sealed against the filling element 3*a* in a manner already described the filling system 1.

A needle-shaped gas channel 32 in the needle-shaped valve body 29.1 remains in constant connection with the return-gas channel 14 even when the return gas-valve 29 closes. This needle-shaped gas channel 32 forms a continuation of the return-gas channel 14*a* that connects the third control valve 31.3 to the pressure-relief channel 19*a* via a gas connection 33. As a result, it is possible for the filling system 1*a* to flush an evacuated container 2 that is connected to the vacuum channel 18*a* with gas from the pressure-relief channel 19*a*.

The following method steps describe one exemplary method for filling of the container 2. In the method steps that follow, all valves are closed unless otherwise stated. In addition, the container 2 remains sealed against the filling element 3*a*.

Referring to FIG. 6, the first step is to evacuate a container 2 by opening the second control valve 31.2 to connect a gas drain 34 that leads from the vacuum channel 18*a* to the annular outlet 8*a*.

The next step is to flush the container. With the second control valve 31.2 still open, the third control valve 30.3 also opens. This introduces flushing gas into the container's interior via the return-gas channel 14*a* and the pressure-relief channel 19*a*. This flushing gas displaces whatever gas is in the container by forcing it through the gas drain 34, through the opened second control-valve 31.2, and on into the vacuum channel 18*a*. Some embodiments choke flow of flushing gas from the pressure-relief channel 19*a* into the container's interior.

The next step is to pressurize the container by raising the valve body 29.1 relative to the return gas tube 11*a*. This opens the return gas valve 29. As a result, inert gas under pressure can flow via the gas channel 14*a* into the container's interior.

With the return gas valve 29*a* still open, the next step is to fill the container by raising the return gas tube 11*a*. This opens the liquid valve 9*a* so that filling content flows out of the reservoir liquid-chamber 4.1 and into the container. Meanwhile, as a result of being displaced by the incoming filling content, the inert gas flows via the opened return gas valve 29 into the reservoir gas-chamber 4.2.

The next step is close all valves, thus ending the filling process and to calming the filling content.

Next comes a pressure-relief step to relieve the pressure in the head space of the filled container 2. This is carried out by opening the first control valve 31.1 so that inert gas flows from the head space, through the gas drain 34 and into the pressure-relief channel 19*a* where it is then available for later flushing.

Referring to FIG. 5, an inert gas channel 30 can serve as a source of fresh inert gas for flushing a container 2. In these embodiments, opening the fourth control-valve 31.4 allows inert gas to flow via the gas connection 33, the needle-shaped gas channel 32, and the return-gas channel 14*a* into the container's interior, which is connected, via the gas drain 34 and the opened second control valve 30.2, to the vacuum channel 18*a*. This flushing with the inert gas from the inert gas channel 30 is particularly useful when there is insufficient gas available in the pressure-relief channel 19*a*. Thus, in the filling element 3*a*, it is possible to compensate for a shortage of flushing gas in the pressure relief channel 19*a* by controlled introduction of inert gas fro either the inert gas channel 30 or the reservoir gas-chamber 4.2.

Another advantage of the filling system 1*a* arises from its ability to not only relieve pressure in a filled container 2 but to also relieve pressure in the return gas tube 11*a*. This is carried out by opening the third control valve 31.3. Such pressure relief avoids any liquid pulses from the return gas tube 11*a* into the container 2 and the concomitant foam formation that accompanies them.

The embodiments described herein feature a great many control valves. In order to reduce the number of control valves of the filling system as a whole, control valves for one group of filling elements 3, 3*a* can be shared by at least two filling elements 3, 3*a* in each case.

I claim:

1. A method comprising sealing a container against a filling element of a filling system, evacuating said container's interior, while evacuating said container's interior, flushing said container's interior with gas, wherein at least some of said gas has already been used during container processing, wherein, as a result, said container's interior is subjected to a pressure of between fifty millibars and two-hundred millibars, filling said container's interior with gas under pressure, and relieving pressure in said container's interior.

2. The method of claim 1, wherein flushing comprises recovering at least some of said gas from a pressure-relief channel that has been used to collect used gas.

3. The method of claim 1, wherein flushing said container's interior with gas, at least some of which has already been used during container processing, comprises introducing said gas, some of which has already been used during container processing, into said container's interior at a pressure of between 1.0 bar and 1.1 bar.

4. The method of claim 1, wherein flushing comprises recovering gas that has already been used for container processing, said recovered gas being at ambient pressure.

5. The method of claim 1, wherein flushing comprises recovering gas that has already been used for container processing, said recovered gas being at a pressure that is higher than ambient pressure.

6. The method of claim 1, wherein flushing comprises subjecting said container's interior to a pressure of 100 mbar.

7. The method of claim 1, wherein flushing comprises introducing said gas into said container's interior along a path that is centered in the container.

8. The method of claim 1, wherein flushing further comprises flushing with fresh gas that has yet to be used in container processing.

9. The method of claim 1, wherein pressure filling further comprises connecting said container's interior to both a flushing channel that is connected to a source of said gas and to a return-gas channel that is connected to a vacuum, wherein flushing comprises introducing said gas through said flushing channel while said return-gas channel is connected to said vacuum.

10. The method of claim 1, wherein pressure filling comprises using a single-chamber filling system comprising a filling element that includes a return gas tube that is configured to extend into said container during container processing, wherein flushing comprises introducing said gas via a return gas channel formed in said return gas tube, and connecting said container's interior via at least one controlled gas path to a vacuum channel of said single-chamber filling system, wherein said controlled gas path opens at a filling content output opening of said filling element.

11. The method of claim 10, further comprising controlling a return gas valve formed in said filling element to control a connection between said return gas tube and a gas chamber of a reservoir of liquid filling-content, said return gas valve having a valve body, wherein flushing comprises causing gas to pass through said valve body.

12. The method of claim 1, wherein subjecting said container's interior to an internal pressure within said range of pressures comprises subjecting said container's interior to said pressure during evacuation of said container.

13. The method of claim 1, wherein subjecting said container's interior to an internal pressure within said range of pressures comprises subjecting said container's interior to said pressure during flushing of said container.

14. The method of claim 1, wherein flushing occurs while said container's interior is connected to said vacuum.

15. The method of claim 1, further comprising causing liquid filling content to enter said container.

16. The method of claim 15, further comprising inhibiting flow of said liquid filling content into said container.

17. The method of claim 15, further comprising choking flow of gas out of said container.

18. The method of claim 15, further comprising calming said liquid filling content.

19. The method of claim 1, further comprising recovering gas that has been used to flush another container and using said gas to flush said container.

20. An apparatus specifically designed for connecting a container's interior to a vacuum, evacuating said container's interior, while evacuating said container's interior, flushing said container's interior with gas, wherein, as a result, said container's interior is subjected to an internal pressure that is within a range of pressures, wherein said range of pressures is a range that extends between fifty millibars and two-hundred millibars, wherein at least some of said gas has already been used during container processing, filling said container's interior with gas under pressure, and relieving pressure in said container's interior, wherein said apparatus comprises a pressure-relief channel, a vacuum channel, and a filling-content reservoir, wherein said filling-content reservoir is connected to at least one filling element, wherein said pressure-relief channel is connected to said at least one filling element, wherein said vacuum channel is connected to said at least one filling element, wherein each filling element from said at least one filling element comprises a housing, a liquid valve, a liquid channel, an opening, a flushing tube, a flushing channel, and a return-gas tube, wherein said opening is an annular discharge opening, wherein said return-gas tube comprises a return-gas channel, a first gas chamber, a second gas chamber, a plurality of controlled gas paths, a first control valve that controls at least one of said controlled gas paths, a second control valve that controls at least one of said controlled gas paths, and a fourth control valve that controls at least one of said controlled gas paths, wherein said liquid channel is formed in said housing, wherein said annular discharge opening is on an underside of said filling element, wherein, during operation, liquid filling-content from said filling-content reservoir is discharged into a container sealed against said filling element through said annular discharge opening, wherein said flushing channel extends through said flushing tube, wherein said flushing tube is configured to extend downward through said opening during filling of a container, wherein said return-gas tube is configured to extend downward through said opening during filling of a container, wherein said return gas channel is an annular channel that surrounds said flushing tube, wherein said first gas chamber is formed in said housing, wherein said return gas channel comprises an end that is remote from said annular discharge opening, wherein said end of said return gas channel opens into said first gas chamber, wherein said second gas chamber is formed in said housing, wherein said flushing channel opens into said second gas chamber, wherein said fourth control valve is configured to connect said pressure-relief channel to said second gas chamber, wherein said second control valve is configured to connect said vacuum channel to said flushing channel of said flushing tube during evacuation and flushing of said container, wherein said second control valve is configured to connect said vacuum channel to said first gas chamber during evacuation and flushing of said container, wherein, in the course of evacuation and flushing of said container, said second control valve is configured to establish a connection between said vacuum channel and said return gas channel, wherein said second control valve is configured to connect said pressure-relief channel to said return gas channel during a residual pressure relief phase, wherein said first control valve is configured to connect said first gas chamber to said pressure-relief channel during residual pressure relief of said container, and wherein said first control valve is configured to connect said return gas channel to said pressure-relief channel during a residual pressure relief of said container.

* * * * *